US006099669A

United States Patent [19]

Yuki et al.

[11] Patent Number: 6,099,669

[45] **Date of Patent: *Aug. 8, 2000**

[54] METHOD FOR PRODUCING A FE-NI ALLOY SHEET AND A FE-NI ALLOY SHADOW MASK

[75] Inventors: Norio Yuki; Toshiyuki Ono; Tetsuo Kawahara, all of Kanagawa, Japan

[73] Assignee: Nippon Mining & Metals Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,499

[22] Filed: Mar. 7, 1997

[30] Foreign Application Priority Data

Mar. 7, 1996 [JP] Japan ..... 8-050549

[51] Int. Cl.[7] ..... C22F 1/10; B21J 1/02

[52] U.S. Cl. ..... 148/621; 148/651; 148/653

[58] Field of Search ..... 148/621, 651, 148/653, 336

[56] References Cited

U.S. PATENT DOCUMENTS 3,657,026 4/1972 Colling ..... 148/120

FOREIGN PATENT DOCUMENTS 3636815 5/1987 Germany .
360128253 7/1985 Japan .
61-044126 3/1986 Japan .

*Primary Examiner*—Sikyin Ip
*Attorney, Agent, or Firm*—Birch, Stewart, Kolasch & Birch, LLP

[57] ABSTRACT

Composition segregation which results in streaks in an Fe—Ni alloy sheet shadow-mask is prevented by the following conditions. Heat-treatment from 1150° C. to a temperature lower than the melting point for longer than 1 hour and not longer than 30 hours. Subsequent rough-rolling or forging at a reduction of area of 40% or more. A slab is subjected to removal of oxide scale on its surface and then heated in hydrogen atmosphere having dew point of 10° C. or lower at a temperature of not less than 1100° C. and lower than the melting point for time (t - hour) which is defined by:

$$t \geqq [3.8\times10^{-7} \exp (23830/T)]/R,$$

where R is reduction area (%) at the slab production.

14 Claims, 1 Drawing Sheet

METHOD FOR PRODUCING A FE-NI ALLOY SHEET AND A FE-NI ALLOY SHADOW MASK

BACKGROUND OF INVENTION

1. Field of Invention

The present invention relates to a method for producing an Fe—Ni alloy sheet and an Fe—Ni alloy shadow mask which is formed by means of etching an Fe—Ni alloy sheet. More particularly, the present invention provides an improvement in the production method of an Fe—Ni alloy sheet so as to suppress the formation of streaks which appear when apertures are pierced for passing an electron beam through the shadow-mask material.

2. Description or Related Art

Heretofore, mild steel has been ordinarily used as the material of the shadow mask in a color Braun tube. The shadow mask undergoes temperature-rise, and hence thermal expansion, due to the irradiation of the electron beam during continuous operation of the color Braun tube. This thermal expansion causes shift between the irradiating position of an electron beam and fluorescent material and hence color deviation on the color Braun tube. Therefore, an Fe—Ni alloy having a low coefficient of thermal expansion, which is referred to as the "36 alloy", is used to prevent the color deviation.

A shadow mask is formed by etching an Fe—Ni alloy sheet to pierce an aperture for passing an electron beam therethrough. When a light source is then located at the rear side of a mask and the mask is observed at the front side, a streak-form pattern elongating in the rolling direction is occasionally observed. This is a defect referred to as streak failure.

A failure in the form of streaks is occasionally formed in the case of the shadow mask made of soft steel. It is known that this is mainly due to non-metallic inclusions and carbides. The streaks are not prevented in the case of an Fe—Ni alloy, even by means of decreasing the non-metallic inclusions. The streaks of an Fe—Ni alloy are believed to be attributable to the composition segregation which is inherent in binary alloys, of which the Fe—Ni alloy is one.

There are proposals for decreasing the composition segregation of an Fe—Ni alloy as follows. (1) Japanese Unexamined Patent Publication No. 60-128,253, which proposes to heat the cast ingot, prior to forging, to a temperature of not lower than 850° C. and lower than the melting point. (2) Japanese Unexamined Patent Publication No. 60-56,053 which proposes to subject the hot-rolled plate to soaking heat-treatment. (3) Japanese Unexamined Patent Publication No. 2-170,922 which proposes to subject the continuously cast slab to soaking at a temperature of from 1200° to 1350° C. for 1 hour or longer, heating at a temperature of from 1100° to 1200° C. in an atmosphere having oxygen concentration of 0.1 volume % or less and then hot-rolling.

When an Fe—Ni alloy is heated to a high temperature for a long time in air, its grain boundaries are severely oxidized. Since the heating of the cast products according to the methods of prior art (1) and (3) intends to decrease the segregation of components by means of prolonged soaking, the cast products must be subsequently ground thoroughly so as to completely remove the oxidized surface where the grain-boundary oxidation occurs. This leads to decrease the yield of product.

When a hot-rolled plate is soaked according to the prior art (2), the proportion of the grain-boundary oxidized surface layer to the plate thickness is so increased as to seriously decrease the yield of product.

In addition, although an improvement is attained by the methods of prior art (1) and (3), these methods cannot satisfactorily prevent fine streaks, which do not appear in the conventional mask but appear in the recent, very fine mask having fine pitches of apertures. A further improvement is therefore expected.

SUMMARY OF INVENTION

It is therefore an object of the present invention to provide a method for producing, in high yield, an Fe—Ni alloy sheet, in which streaks, which may be formed in the production process of a shadow mask when apertures are pierced for passing an electron beam, can be suppressed.

It is another object of the present invention to provide an Fe—Ni alloy shadow mask which is free of streaks.

The present inventors investigated how to achieve the object of the present invention and then discovered the following.

Namely, the components segregation of a cast Fe—Ni alloy product, which may result in formation of the streaks, can be effectively diminished, by means of plastic working such as forging or rough-rolling to change the cast structure, and subseqent heating in hydrogen stmoshere, without incurring oxidation, for the time required for diminishing the streaks, which is dependent upon the heating time of an ingot and upon reduction of area at the forging or rough-rolling of an ingot.

The present invention is based on the above discoveries and provides the following methods (1) and (2).

(1) A method for producing an Fe—Ni alloy sheet, comprising the steps of:

heat-treating at a temperature not lower than 1150° C. and lower than the melting point for longer than 1 hour and not longer than 30 hours an Fe—Ni alloy ingot, which contains from 30 to 45% by weight of Ni, the balance being essentially Fe and unavoidable impurities and incidental elements selected from the group consisting of not more than 0.10% by weight of C, not more than 0.30% by weight of Si, not more than 0.30% by weight of Al, not more than 0.5% by weight of Mn, not more than 0.005% by weight of S, and not more than 0.005% by weight of P;

forging the Fe—Ni alloy ingot at reduction of area of not less than 40% to form a slab;

removing an oxide scale on the slab;

then, heat-treating the slab in hydrogen atmosphere having a dew point of not higher than −10° C. at a temperature not lower than 1100° C. for a time fulfilling the equation given below; and, then, hot-rolling the slab.

(2) A method for producing an Fe—Ni alloy sheet, comprising the steps of:

heat-treating at a temperature not lower than 1150° C. and lower than the melting point for longer than 1 hour and not longer than 30 hours an Fe—Ni alloy ingot, which contains from 30 to 45% by weight of Ni, the balance being essentially Fe and unavoidable impurities, and incidental elements selected from the group consisting of not more than 0.10% by weight of C, not more than 0.30% by weight of Si, not more than 0.30% by weight of Al, not more than 0.5% by weight of Mn, not more than 0.005% by weight of S, and not more than 0.005% by weight of P;

rough-rolling the Fe—Ni alloy ingot at reduction of area not less than 40% to form a slab;

removing an oxide scale on the slab;

then, heat-treating the slab in hydrogen atmosphere having a dew point of not higher than −10° C. at a temperature not lower than 1100° C. for a time fulfilling the equation given below; and, then, hot-rolling the slab.

$$t \geq [3.8\times10^{-7} \exp(23830/T)]/R,$$

wherein t: heating time of a slab (hr)

T: heating temperature of a slab (°C.)

R: reduction of area of a slab (%)

The present invention also provides an Fe—Ni alloy shadow mask produced by the method (1) or (2).

BRIEF DESCRIPTION OF DRAWING

In FIG. 1, the symbols refer to: d-depth; SE-amount of side etch; EF=d/SE; r-diameter of an aperture through a photo-resist layer; R- diameter of an aperture formed by etching; and, SE=(I−r)/2.

Figure 1:
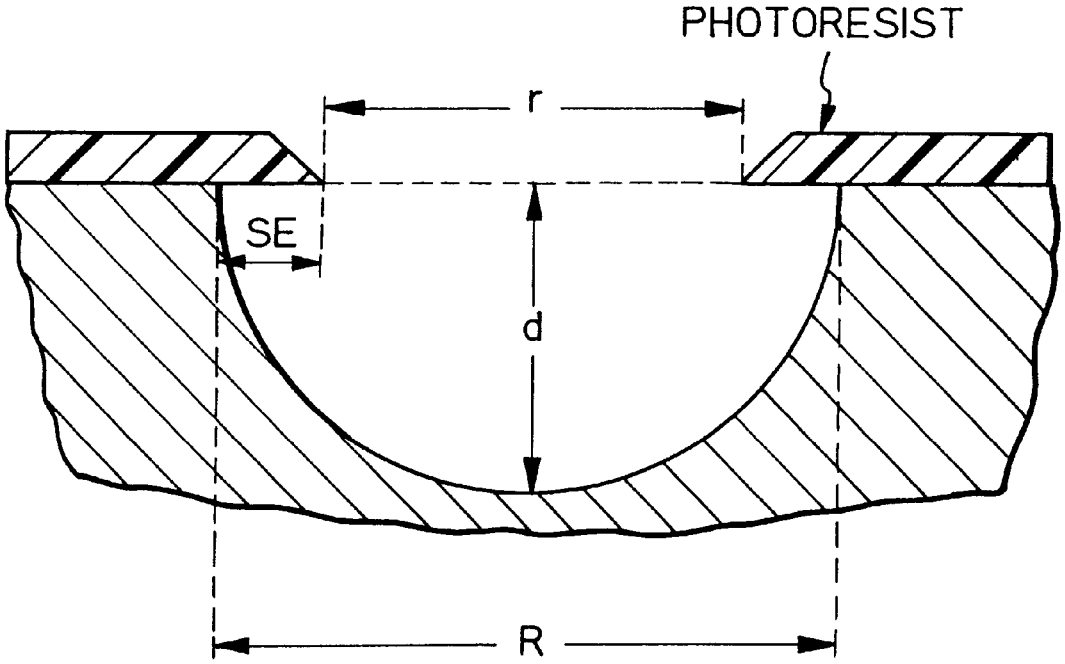
FIG. 1 is a drawing illustrating the etching factor.

The Ni content of the Fe—Ni alloy material is limited in a range of from 30 to 45% by weight, because at a Ni content of more than 30% and less than 45% the coefficient of thermal expansion greatly increases, rendering to make the material inappropriate for the shadow mask. In addition, content of incidental elements and impurities is limited for the following reasons. The incidental elements not only bring about detrimental may bring about advantageous effects, such as enhancement of the strength and workability, provided that their content is less than the upper limit, a) Carbon Content When the carbon content is more than 0.10% by weight, the etching property to pierce the apertures is so disadvantageously impeded by the carbide as to make the Fe—Ni alloy inappropriate for the shadow mask.

b) Silicon Content

When the silicon content is more than 0.30% by weight, the etching property to pierce the apertures is so disadvantageously impeded as to make the Fe—Ni alloy inappropriate for the shadow mask.

c) Aluminum Content

When the aluminum content is more than 0.30% by weight, the alumina-based inclusions are formed in such amount as to impair the etching property to pierce the apertures.

d) Manganese Content

Manganese is added to steel alloys to offset the effect of sulfur harmless, which impairs the hot-workability. When the content of Mn is small, no appreciable benefit is obtained. However, when the Mn content exceeds 0.5% by weight, the material temper is so hardend that formability is lost. The upper limit of manganese is, therefore, set at 0.5% by weight.

The etching factor (EF) is more enhanced at a lower Mn content. Meanwhile, Mn should be present at least in such an amount as to fix the sulfur, which is one of the impurities, to enhance the etching factor.

e) Sulfur Content

When the sulfur content is more than 0.005% by weight, the hot-workability of material is seriously impaired. When the sulfur content is decreased to a low level as above, the Mn content can be as low as 0.1% by weight or less.

f) Phosphorus Content

When the content of phosphorus, which is another impurity, is more than 0.005% by weight, the etching property to pierce the apertures is so impeded as to make the Fe—Ni alloy inappropriate for the shadow mask.

The working method, which is one of the most characterizing features of the present invention, is described hereinafter.

The working process according to the present invention fundamentally involves either the ingot-forging and slab-rolling or the ingot rough-rolling and slab-rolling. Each of the ingot-forging, rough-rolling of an ingot and slab-rolling processes may be carried in a plurality of steps with an intermediate heating step. The intermediate heating temperature and time may be such as to enable working of the ingot or slab. The intermediate heating of a slab in the hot-rolling step is effective to decrease the segregation of components. The intermediate heating time ($t_1$) can, therefore, be advantageously selected such that the total heating time of $t_1$ and $t_2$ fulfills the equation (t), where $t_2$ is the final heating time. The total heating time can thus be shortened.

g) Heat-Treating Condition of Ingot

Heat treatment of an ingot prior to the forging or rough-rolling should be carried out under such conditions that up to the interior the ingot is heated to a homogeneous temperature. When the heating time is shorter than 1 hour, the heating may end while the ingot interior is not yet heated to a predetermined temperature. In this case, the segregation in an ingot is not diminished, and, therefore, streaks cannot be diminished even if a slab is hot-rolled under a condition satisfying the following experimental equation. On the other hand, when the longest heating time exceeds 30 hours, the forging or rough-rolling process becomes so expensive that it cannot be implemented industrially. The heating time is, therefore, from 1 hour and shorter than 30 hours.

When the heating of an ingot is carried out at a temperature of 1150° C. or lower, it is not very effective to decrease the segregation of the components in an ingot.

After heat-treating, an ingot may be immediately forged or rough-rolled or may be cooled and then reheated to a temperature which enables the forging or rough-rolling.

When the reduction of area of an ingot in the forging or rough rolling is less than 40%, the plastic deformation of an ingot is not satisfactory. When the poorly plastic deformed slab is subsequently heated under the condition satisfying the equation described below, the subsequent heating is not effective for diminishing the segregation of components. The reduction of area of an ingot in the forging or rough-rolling is, therefore, set to be 40% or more.

i) Heat Treatment of Slab

The present inventors carried out experiments in a factory and then discovered that the appropriate heating time of a slab can be determined depending upon the heating time of an ingot and the reduction area of an ingot.

$$\text{Log } t \geq \log (A/R) + B/T$$

In this experimental equation, "t" denotes the heating time of a slab, "A" and "B" denote the constants, "T" denotes the heating temperature, and, "R" is the reduction of area of an ingot, when the ingot is forged or rough-rolled to produce a slab. This equation indicates that, when the heating temperature becomes high (decrease in the second term of the right side), the shortest heating time (the logarithm "t" of the left side becomes short). This equation indicates also that when the reduction of area of a slab becomes small (the logarithm of the first term of the right side becomes large), the heating time of a slab prior to rolling becomes long.

When the parameters of the experimental equation are substituted for definite numerals and expanded, the equation stipulating the inventive condition is obtained as follows.

$$t \geq [3.8\times10^{-7}\exp(23830/T)]/R$$

A slab can be produced at a low working cost, when R is in the range of from 60 to 85%.

When the heating time is shorter than the equation (t), the segregation of components cannot be effectively decreased so as to prevent streak failure. Since the cast structure has been plastically deformed in a slab, the heating temperature of the slab may be lower than that of an ingot so as to diminish the segregation of components. The lowest heating temperature is, therefore 1100° C. At a lower temperature than 1100° C., the heating time becomes disadvantageously long. The atmosphere of heat treatment is hydrogen so as to prevent oxidation and hence to lessen the removal amount of oxide scale after hot-rolling. The dew point of the hydrogen atmosphere is preferably −10° C. or lower.

A slab is hot-rolled to produce a rolled sheet having a thickness of from 2 to 5 mm. Subsequently, cold-rolling, skin-pass rolling, pickling, annealing and stress-relief annealing are usually carried out to produce the material of a shadow mask.

The present invention is hereinafter described with reference to the examples.

EXAMPLE

Fe—Ni alloys, composition of which was adjusted as given below, were melted by a vacuum-melting method, and the resultant melt was cast into an ingot having a square cross-section, 750 mm square at the top. Heat treatment of the ingots was carried out under the conditions given in Table 1. Forging or rough-rolling was carried out to produce 160-mm-thick slabs. The oxide scale on the slabs was removed and the heat treatment of the slabs was then carried out under the conditions given in Table 1. The hot-rolling was then carried out. Cold-rolling and annealing were repeated to produce 0.13-mm-thick alloy strips.

TABLE 1

| Samples | Heat Treatment Condition of Ingot: Temperature (° C.) | Heat Treatment Condition of Ingot: Time (hour) | Forging or Rough Rolling | Reduction of Area (%) | Heat Treating Condition of Slab: Temperature (° C.) | Heat Treating Condition of Slab: Time (hour) | Heat Treating Condition of Slab: Gas | Heat Treating Condition of Slab: Dew Point (° C.) | t-equation calculated value |
|---|---|---|---|---|---|---|---|---|---|
| Inventive | | | | | | | | | |
| 1 | 1220 | 15 | Forging | 82 | 1150 | 6 | hydrogen | −20 | 4.6 |
| 2 | 1220 | 7 | Rough Rolling | 75 | 1180 | 5 | hydrogen | −20 | 3.0 |
| 3 | 1250 | 5 | Forging | 55 | 1220 | 3 | hydrogen | −25 | 2.1 |
| 4 | 1250 | 5 | Rough Rolling | 75 | 1240 | 2 | hydrogen | −25 | 1.1 |
| 5 | 1280 | 15 | Forging | 85 | 1240 | 2 | hydrogen | −15 | 1.0 |
| Comparative | | | | | | | | | |
| 6 | 1150 | 0.5 | Forging | 78 | 1180 | 4 | hydrogen | −15 | 2.6 |
| 7 | 1250 | 15 | Forging | 35 | 1200 | 6 | hydrogen | −20 | 4.6 |
| 8 | 1250 | 5 | Rough Rolling | 33 | 1200 | 6 | hydrogen | −20 | 4.8 |
| 9 | 1220 | 15 | Forging | 75 | 1200 | 1.5 | hydrogen | −15 | 2.1 |
| 10 | 1220 | 7 | Rough Rolling | 75 | 1050 | 40 | hydrogen | −15 | 4.8 |
| 11 | 1250 | 7 | Forging | 74 | 1220 | 3 | hydrogen | 0 | 1.6 |
| 12 | 1220 | 5 | Forging | 76 | 1240 | 2 | air | 0 | 1.1 |

The composition of Fe—Ni alloy was as follows: 36.2% of Ni, 0.007% of C, 0.05% of Si, 0.005% of Al, 0.25% of Mn, 0.002% of S and 0.003% of P.

Among the produced strips, Sample Nos. 1 through 5 are the examples satisfying the requirements of the present invention, and Sample Nos. 6 through 12 are the comparative examples. In the comparative examples, Sample No. 6 does not satisfy the inventive condition for heating of an ingot. Sample Nos. 7 and 8 do not satisfy reduction of area in the forging or rough-rolling, because it is less than 40%. Sample No. 9 does not satisfy the inventive condition for slab-heating stipulated by the equation "t", Sample No. 10 does not satisfy the inventive temperature for slab-heating. The slabe heating is carried out in air in Sample No. 12 or under the dew point of higher than −10° C. in Sample No. 11.

Well-known photolithography was applied to the produced sheets as follows. A photo-resist mask was applied on one side of the sheets and a number of 80-μm-diameter true round apertures were formed through the photo-resist mask. The other photo-resist mask was applied on the other side of the sheets and a number of 180-μm-diameter true round apertures were formed through the photo-resist mask. The ferric chloride aqueous solution in the form of spray was blown on the photo-resist masks so as to form apertures through the Fe—Ni alloy sheets. The material of the shadow mask was thus prepared.

The side of the sheet with small-diameter apertures was faced to an observer, and the other side with large-diameter apertures was faced to a light source. The light was irradiated obliquely to the other side and the presence or absence was observed.

The yield was evaluated by measuring the surface grinding amount to remove the oxide scale before hot-rolling the sheets.

The results of the inventive and comparative examples are given in Table 2.

TABLE 2

| Samples | Surface-Grinding Amount (μm) | Generation of Streaks | Remarks |
|---|---|---|---|
| 1 | 70 | none | inventive |
| 2 | 70 | none | inventive |
| 3 | 60 | none | inventive |
| 4 | 75 | none | inventive |
| 5 | 65 | none | inventive |
| 6 | 70 | present | comparative |
| 7 | 70 | slight | comparative |
| 8 | 75 | slight | comparative |
| 9 | 65 | present | comparative |
| 10 | 95 | none | comparative |
| 11 | 120 | none | comparative |
| 12 | 150 | none | comparative |

Sample Nos. 1 through 5 satisfy the following conditions: (i) heat treatment of an ingot for 1200° C. or higher for longer than 1 hour; (ii) forging and rough-rolling at a reduction of area of 40% or more to form a slab; (iii) oxide scale on the slab is removed; (iv) heat-treatment of a slab at 1100° C. or higher for the time satisfying the-equation (t); and, (v) hot-rolling. These inventive samples did not produce streaks, when the apertures for passing an electron beam are formed by etching. In addition, the surface grinding amount of hot-rolled sheets to remove the oxide scale is small, and, hence the yield is high.

Contrary to this, streaks are formed in Sample No. 6, because of low heat-treating temperature and short heat-treating time of an ingot. Slight streaks are formed in Sample Nos. 7 and 8, because of less than 40% of reduction area in the forging and rough-rolling. Streaks are formed in Sample No. 9, because the heat-treating condition of a slab does not satisfy the heating time (t). In Sample No. 10, since the heating temperature is lower than 1100° C., the time required for uniform heating is prolonged so that this condition is economically inappropriate for industrial production. The dew point of hydrogen atmosphere is higher than −10° C. in Sample No. 11 and the heating atmosphere is not hydrogen in Sample 12. Therefore, the surface and grain-boundary are highly oxidized in Sample Nos. 11 and 12. The removal amount of oxide scale on the hot-rolled steel in these comparative examples is as high as twice that of the inventive examples, and hence yield is low.

What is claimed is:

1. A method for producing an Fe—Ni alloy sheet, comprising the steps of:

heat-treating at a temperature not lower than 1150° C. and lower than the melting point for longer than 1 hour and not longer than 30 hours an Fe—Ni alloy ingot, which contains from 30 to 45% by weight of Ni, the balance being essentially Fe and unavoidable impurities and incidental elements selected from the group consisting of not more than 0.1% by weight of C., not more than 0.30% by weight of Si, not more than 0.30% by weight of Al, not more than 0.5% by weight of Mn, not more than 0.005% by weight of S, and not more than 0.005% by weight of P;

forging the Fe—Ni alloy ingot at reduction of area not less than 40% to form a slab;

removing oxide scale on the slab;

heat-treating the slab in hydrogen atmosphere having a dew point of not higher than −10° C. at a temperature not lower than 1100° C. for a time fulfilling the equation given below $$t \geqq (3.8\times10^{-7} \exp (23830/T))/R,$$

wherein t: heating time of a slab (hr)

T: heating temperature of a slab (°C.)

R: reduction by area of a slab (%); then hot-rolling the slab to form a hot-rolled plate; and forming an Fe—Ni alloy sheet from the hot-rolled plate, whereby the method prevents shadow mask streak generation.

2. A method for producing an Fe—Ni alloy sheet according to claim 1, further comprising the steps of cold-rolling the hot-rolled plate to form a cold-rolled sheet; and, annealing the cold-rolled sheet.

3. A method for producing an Fe—Ni alloy sheet according to claim 2, wherein the slab has a thickness that is 32–80 times greater than the thickness of the hot-rolled plate.

4. A method for producing an Fe—Ni alloy sheet according to claim 3, wherein the hot-rolled plate has a thickness 15.38–38.46 times greater than the thickness of the Fe—Ni alloy sheet.

5. A method for producing an Fe—Ni alloy sheet according to claim 1 or 2, wherein the heat-treated ingot is immediately forged.

6. A method for producing an Fe—Ni alloy sheet according to claim 1 or 2, wherein the heat-treated slab is immediately hot-rolled.

7. A method for producing an Fe—Ni alloy sheet according to claim 6, wherein the heat-treated ingot is immediately forged.

8. A method for producing an Fe—Ni alloy sheet, comprising the steps of:

heat-treating at a temperature not lower than 1150° C. and lower than the melting point for longer than 1 hour and not longer than 30 hours an Fe—Ni alloy ingot, which contains from 30 to 45% by weight of Ni, the balance being essentially Fe and unavoidable impurities and incidental elements selected from the group consisting of not more than 0.10% by weight of C, not more than 0.30% by weight of Si, not more than 0.30% by weight of Al, not more than 0.5% by weight of Mn, not more than 0.005% by weight of S, and not more than 0.005% by weight of P;

rough rolling the Fe—Ni alloy ingot at reduction of area not less than 40% to form a slab;

removing oxide scale on the slab;

heat-treating the slab in hydrogen atmosphere having a dew point of not higher than −10° C. at a temperature not lower than 1100° C. for a time fulfilling the equation given below $$t \geqq (3.8\times10^{-7} \exp (23830/T))/R,$$

wherein t: heating time of a slab (hr)

T: heating temperature of a slab (°C.)

R: reduction by area of a slab (%); then hot-rolling the slab to form a hot-rolled plate; and forming an Fe—Ni alloy sheet from the hot-rolled plate, whereby the method prevents shadow mask streak generation.

9. A method for producing an Fe—Ni alloy sheet according to claim 8, further comprising the steps of cold-rolling the hot-rolled plate to form a cold-rolled sheet; and, annealing the cold-rolled sheet.

10. A method for producing an Fe—Ni alloy sheet according to claim 9, wherein the slab has a thickness that is 32–80 times greater than the thickness of the hot-rolled plate.

11. A method for producing an Fe—Ni alloy sheet according to claim 10, wherein the hot-rolled plate has a thickness 15.38–38.46 times greater than the thickness of the Fe—Ni alloy sheet.

12. A method for producing an Fe—Ni alloy sheet according to claim 8 or 9, wherein the heat-treated ingot is immediately forged.

13. A method for producing an Fe—Ni alloy sheet according to claim 8 or 9, wherein the heat-treated slab is immediately hot-rolled.

14. A method for producing an Fe—Ni alloy sheet according to claim 13, wherein the heat-treated ingot is immediately forged.

* * * * *